US011359404B2

(12) United States Patent
Sawa et al.

(10) Patent No.: US 11,359,404 B2
(45) Date of Patent: Jun. 14, 2022

(54) DOOR HARDWARE LOCATING TOOL

(71) Applicant: MILWAUKEE ELECTRIC TOOL CORPORATION, Brookfield, WI (US)

(72) Inventors: Max R. Sawa, Palatine, IL (US); James E. Pangerc, Pewaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 439 days.

(21) Appl. No.: 16/675,326

(22) Filed: Nov. 6, 2019

(65) Prior Publication Data

US 2020/0141153 A1 May 7, 2020

Related U.S. Application Data

(60) Provisional application No. 62/756,283, filed on Nov. 6, 2018.

(51) Int. Cl.
*E05B 17/06* (2006.01)

(52) U.S. Cl.
CPC ..... *E05B 17/06* (2013.01)

(58) Field of Classification Search
CPC ..... E05B 17/06
USPC ..... 33/194, 197
See application file for complete search history.

(56) References Cited

U.S. PATENT DOCUMENTS 3,021,734 A 2/1962 Schlage
3,338,277 A 8/1967 Tornoe et al.
3,700,344 A 10/1972 Grumbach
4,130,930 A 12/1978 Webster
4,199,060 A 4/1980 Howard
4,248,554 A 2/1981 Boucher et al.
4,280,776 A 7/1981 Chaconas et al.
4,306,823 A 12/1981 Nashlund
4,715,125 A 12/1987 Livick
4,813,826 A 3/1989 Riedel
4,815,215 A 3/1989 Saylor et al.
5,046,901 A 9/1991 Taylor
5,067,537 A 11/1991 Offner
5,114,285 A 5/1992 Brydon
(Continued)

FOREIGN PATENT DOCUMENTS

CN 2846628 Y 12/2006
CN 200939515 Y 8/2007
(Continued)

*Primary Examiner* — George B Bennett
(74) *Attorney, Agent, or Firm* — Michael Best & Friedrich LLP

(57) ABSTRACT

A door hardware locating tool includes an edge wall having a first side, a second side opposite the first side, and an edge bore aperture that extends through the first and second sides. The edge bore defines a first axis that extends centrally through the edge wall and through the first and second sides. The door hardware locating tool also includes a side wall adjacent the edge wall. The side wall includes a first side, a second side opposite the first side, and a cavity defined between the first and second sides. The door hardware locating tool further includes an insert at least partially positioned within the cavity of the side wall. The insert is rotatable about a second axis that is perpendicular to the first axis between a first position and a second position. The insert includes a cross bore aperture.

20 Claims, 8 Drawing Sheets

(56) References Cited

U.S. PATENT DOCUMENTS

| | | | | |
|---|---|---|---|---|
| 5,116,170 | A * | 5/1992 | Palmer | B23B 47/28 408/72 B |
| 5,146,961 | A | 9/1992 | Schoeller | |
| 5,222,845 | A | 6/1993 | Goldstein et al. | |
| 5,569,001 | A | 10/1996 | Brutscher et al. | |
| 5,573,352 | A | 11/1996 | Matadobra | |
| 6,193,449 | B1 | 2/2001 | Diaz | |
| 6,343,632 | B1 | 2/2002 | Zivojinovic | |
| 6,390,783 | B1 | 5/2002 | Fridman | |
| 6,398,465 | B1 | 6/2002 | Monge | |
| 6,910,837 | B2 | 6/2005 | Trettin et al. | |
| 6,954,989 | B1 | 10/2005 | Morton | |
| 6,994,498 | B2 | 2/2006 | Trettin et al. | |
| 7,003,889 | B1 * | 2/2006 | Luciani | E05B 17/06 33/562 |
| D516,401 | S | 3/2006 | Snider et al. | |
| D516,891 | S | 3/2006 | Thomas | |
| 7,073,991 | B2 | 7/2006 | Thomas | |
| 7,112,014 | B2 | 9/2006 | Thomas | |
| 7,210,880 | B2 | 5/2007 | Snider | |
| 7,316,527 | B2 | 1/2008 | Trettin et al. | |
| 7,356,902 | B2 | 4/2008 | Snider et al. | |
| 7,421,791 | B2 | 9/2008 | Adkins et al. | |
| 7,530,770 | B2 * | 5/2009 | Chao | B23B 47/287 408/103 |
| 8,443,523 | B2 | 5/2013 | Lam et al. | |
| 9,284,747 | B2 | 3/2016 | Ward | |
| 9,403,219 | B2 * | 8/2016 | Trettin | E05B 17/06 |
| 9,850,670 | B2 | 12/2017 | Ward | |
| 11,208,832 | B2 * | 12/2021 | Capozziello | E05B 63/20 |
| 2003/0172535 | A1 | 9/2003 | Grizzle | |
| 2004/0020809 | A1 | 2/2004 | Allan et al. | |
| 2005/0072701 | A1 | 4/2005 | Allan et al. | |
| 2005/0129472 | A1 | 6/2005 | Liu et al. | |
| 2005/0210690 | A1 | 9/2005 | Morton | |
| 2007/0041800 | A1 | 2/2007 | Santos | |
| 2007/0086866 | A1 | 4/2007 | Shute et al. | |
| 2007/0227016 | A1 | 10/2007 | Tarter | |
| 2011/0064531 | A1 | 3/2011 | Osborne | |
| 2012/0017452 | A1 | 1/2012 | Lam et al. | |
| 2016/0325361 | A1 | 11/2016 | Trettin et al. | |

FOREIGN PATENT DOCUMENTS

| | | | |
|---|---|---|---|
| EP | 3032022 | A1 | 6/2016 |
| FR | 2645576 | A1 | 10/1990 |
| FR | 2905136 | A1 | 2/2008 |
| GB | 2238749 | A1 | 6/1991 |
| GB | 2546102 | A | 7/2017 |
| WO | 2011130900 | A1 | 10/2011 |

* cited by examiner

DOOR HARDWARE LOCATING TOOL

CROSS-REFERENCE TO RELATED APPLICATIONS

This application claims priority to U.S. Provisional Patent Application No. 62/756,283 filed on Nov. 6, 2018, the entire contents of which is incorporated herein by reference.

FIELD OF INVENTION

The present invention relates to a door hardware locating tool for correctly positioning an edge bore and a cross bore in a door for the installation of door hardware that may include a door lock, a door latch and knob assembly, or a deadbolt.

BACKGROUND

Installing door hardware, such as a door lock, a door latch and knob assembly, or a deadbolt assembly, is often a time consuming operation. First, it is necessary to mark the location of the various holes and recesses on the side and edge of the door into which the lock assembly will be fitted. Using these markings, various tools can be employed to create an edge bore in the edge of the door. In addition, a cross bore must be drilled through the door perpendicular to the edge bore at an appropriate distance from the edge of the door (often referred to as backset). When installing numerous door lock assemblies, such as in a building construction or refurbishment project, it is desirable to fit all the lock assemblies in their respective doors at a consistent height and position throughout the building. In addition, it is desirable for the installation process to be as quick, efficient, and accurate as possible.

SUMMARY OF INVENTION

The present invention may provide, in one independent aspect, a door hardware locating tool including an edge wall having a first side, a second side opposite the first side, and an edge bore aperture that extends through the first and second sides. The edge bore aperture defines a first axis that extends through the edge wall and through the first and second sides. The door hardware locating tool also includes a side wall adjacent the edge wall. The side wall includes a first side, a second side opposite the first side, and a cavity defined between the first and second sides. The door hardware locating tool further includes an insert at least partially positioned within the cavity of the side wall. The insert is rotatable about a second axis that is perpendicular to the first axis between a first position and a second position. The insert includes a cross bore aperture.

The present invention may provide, in another independent aspect, a door hardware locating tool for positioning a cross bore and an edge bore on a door. The door includes a longitudinal axis. The door locating tool includes an edge wall having a first side, a second side opposite the first side, and an edge bore aperture that extends through the first and second sides. The edge bore aperture defines a first axis that extends through the edge bore and through the first and second sides. The door hardware locating tool also includes a side wall adjacent the edge wall having a first side, a second side opposite the first side, and a cavity defined between the first and second sides. The door hardware locating tool further includes an insert at least partially positioned within the cavity of the side wall. The insert is rotatable about a second axis between a first position and a second position. The axis is parallel to the longitudinal axis of the door when the door hardware locating tool is positioned for use. The insert includes a cross bore aperture.

Other independent features and independent aspects of the invention may become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
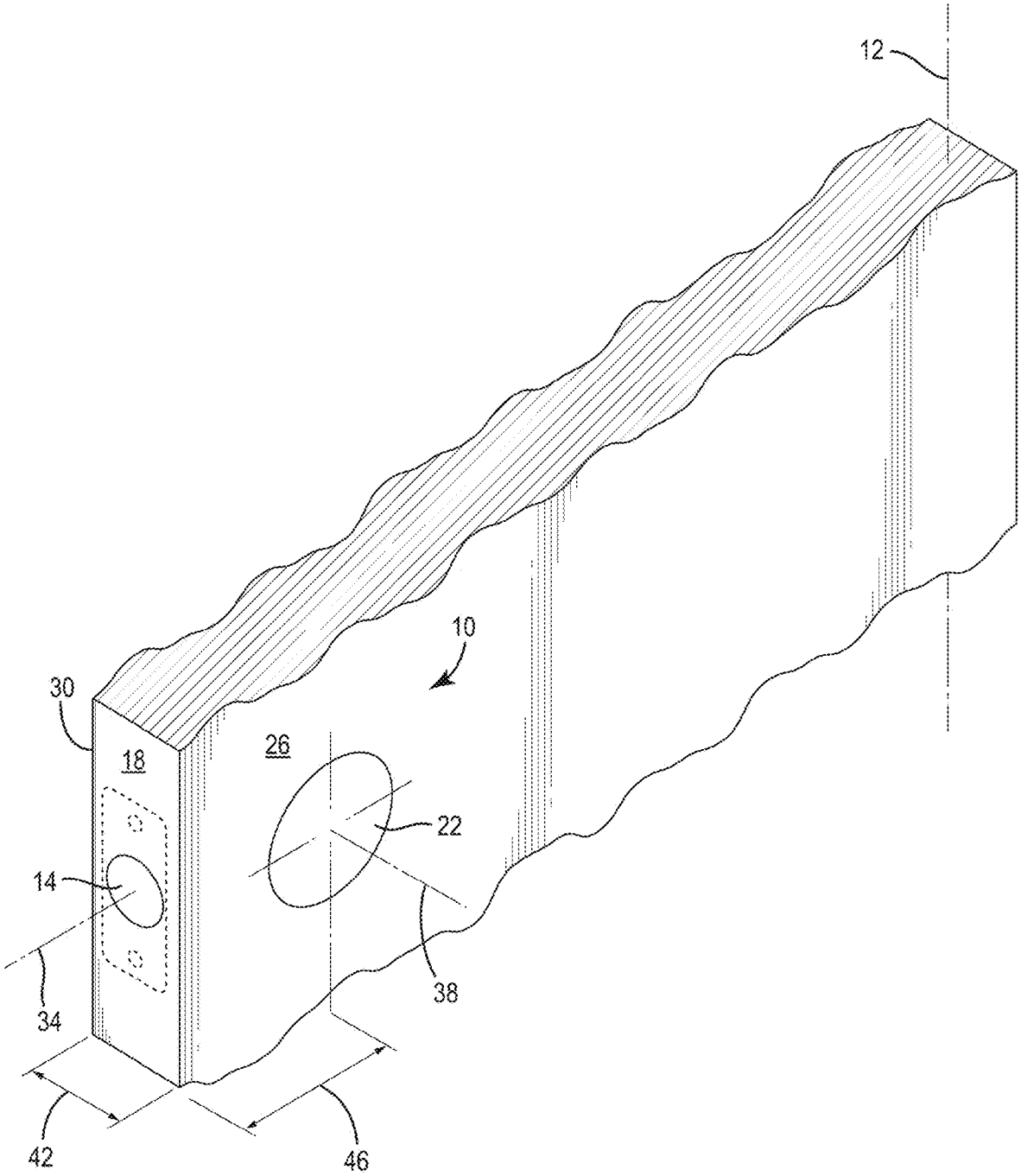
FIG. 1 is a perspective view of a portion of a door.

FIG. 1 illustrates a portion of a door 10 into which door hardware, such as a door lock, a door latch and knob assembly, or a deadbolt assembly, may be installed. The door includes a longitudinal axis 12. Installing the door hardware typically requires an edge bore 14 (also referred to as a latch bore) to be drilled into a latch edge 18 of the door 10 and a cross bore 22 to be drilled through the door 10 through a first side 26 and a second side 30 of the door 10. An edge bore axis 34 extends through a center point of the edge bore 14, and a cross bore axis 38 extends through a center point of the cross bore 22. The edge bore axis 34 is substantially normal to and coplanar with the cross bore axis 38. The edge bore 14 intersects the cross bore 22 inside the door 10. When properly positioned, the plane containing the edge bore axis 34 and the cross bore axis 38 will be substantially perpendicular to the latch edge 18 and the longitudinal axis 12 of the door 10. The edge bore 14 is centered along a width 42 of the latch edge 18. Typical doors 10 have a latch edge width 42 between 1⅜ inches and 1¾ inches. A backset 46 (i.e., the distance from the latch edge 18 to the center point of the cross bore 22) is typically 2⅜ inches or 2¾ inches, depending on the door hardware. The edge bore 14 and the cross bore 22 must also be properly positioned vertically on the door 10. For example, for a door 10 having a height of 80 inches, it may be desirable to position the centers of the edge bore 14 and cross bore 22 at a height of about 36 inches. A door hardware locating tool is used to ensure that the edge bore 14 and the cross bore 22 are properly positioned on the door 10.

FIGS. 2-4 and 9-10 illustrate a door hardware locating tool 100. The tool 100 includes an edge wall or center wall 104, a first wall 108, a second wall 112, and a clamping mechanism 116. The first wall 108 and the second wall 112 are coupled to the edge wall 104 by the clamping mechanism 116, which will be described in greater detail below. The first wall 108 and the second wall 112 extend substantially perpendicularly from the edge wall 104. In the illustrated embodiment, the walls 104, 108, 112 are made of plastic, with other materials also being suitable.

Figure 2:
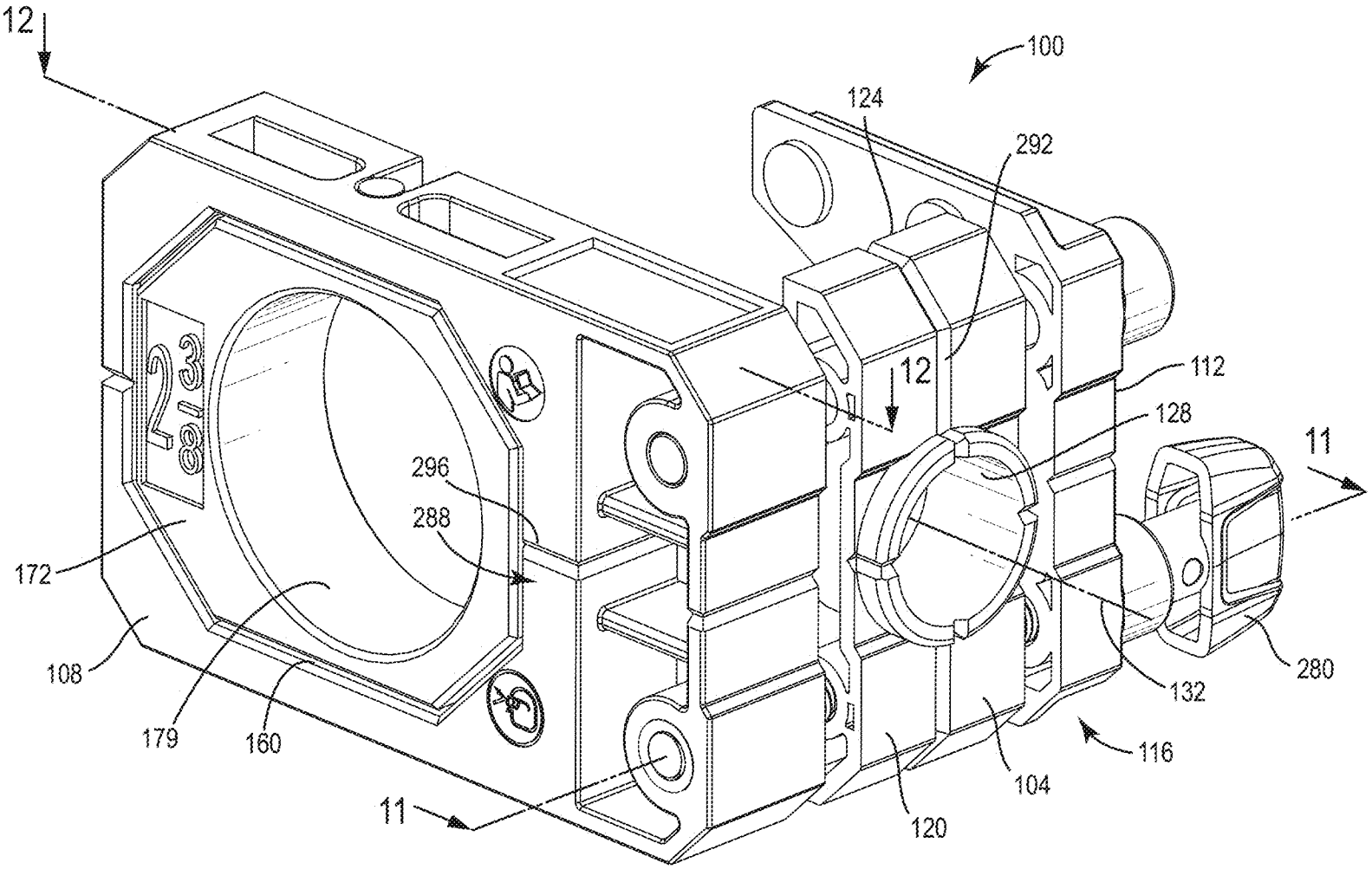
FIG. 2 is a perspective view of a door hardware locating tool according to an embodiment of the invention for facilitating the installation of door hardware on the door of FIG. 1.
Figure 3:
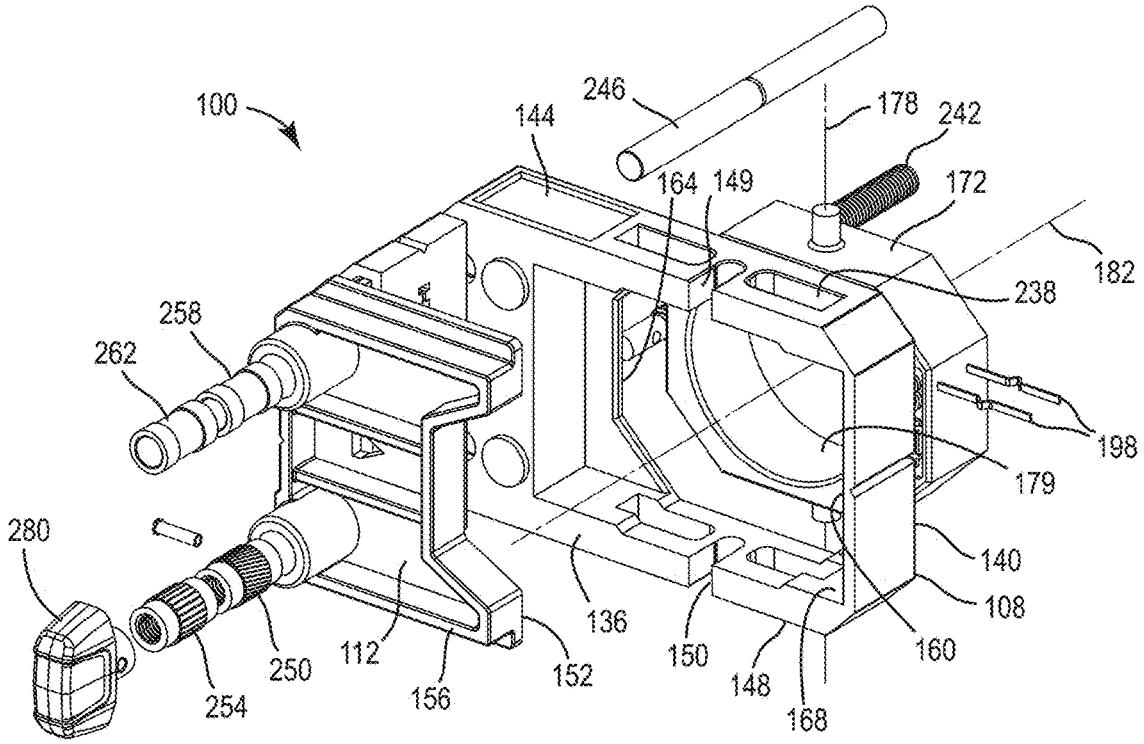
FIG. 3 is an exploded view of the tool of FIG. 2.
Figure 4:
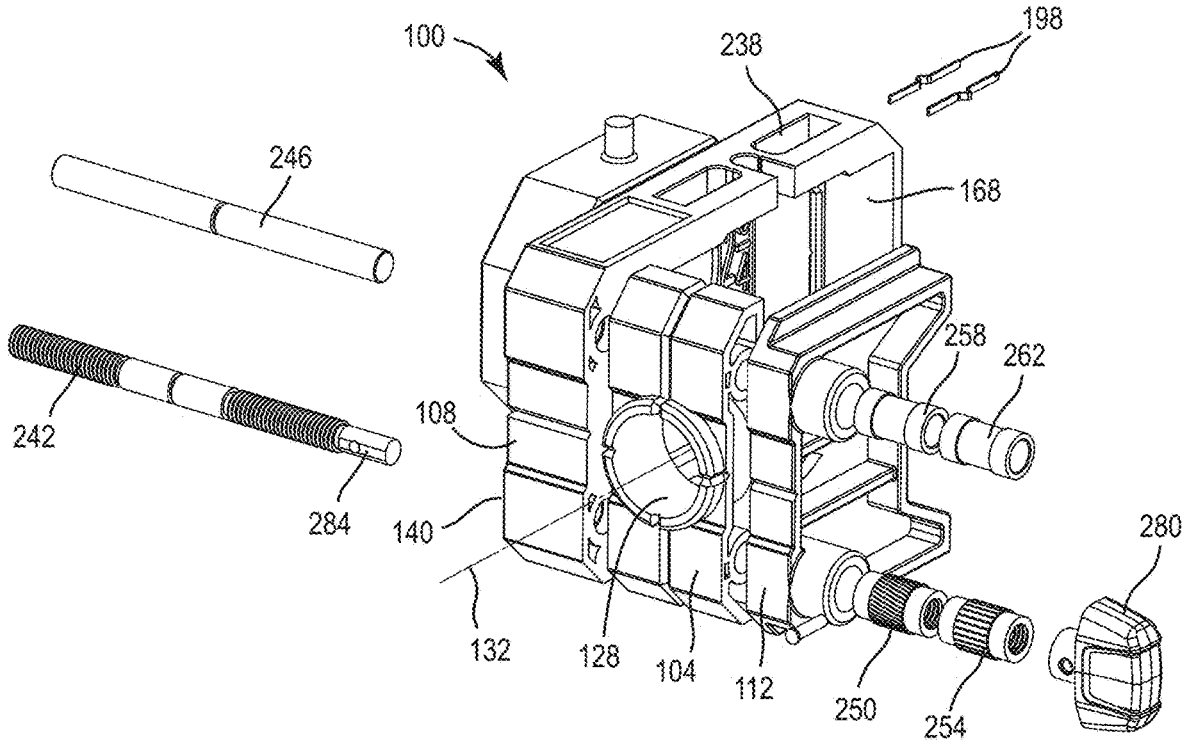
FIG. 4 is another exploded view of the tool of FIG. 2.

With continued reference to FIGS. 2-4, the edge wall 104 includes a first side 120, a second side 124 opposite the first side 120, and an edge bore aperture 128 extending through the first and second sides 120, 124. The edge bore aperture 128 functions as an edge bore locator, and the center of the edge bore aperture 128 defines an edge bore axis 132. The edge bore aperture 128 is circular and is centered in the edge wall 104. The edge bore aperture 128 is sized to receive a cutting tool, such as a hole saw or a drill bit, that is the proper size for creating the latch bore 14. In other embodiments, the edge bore aperture 128 could be larger than the desired latch bore size, and adapters that match standard latch bore sizes could be provided for insertion into the aperture 128.

Figure 8:
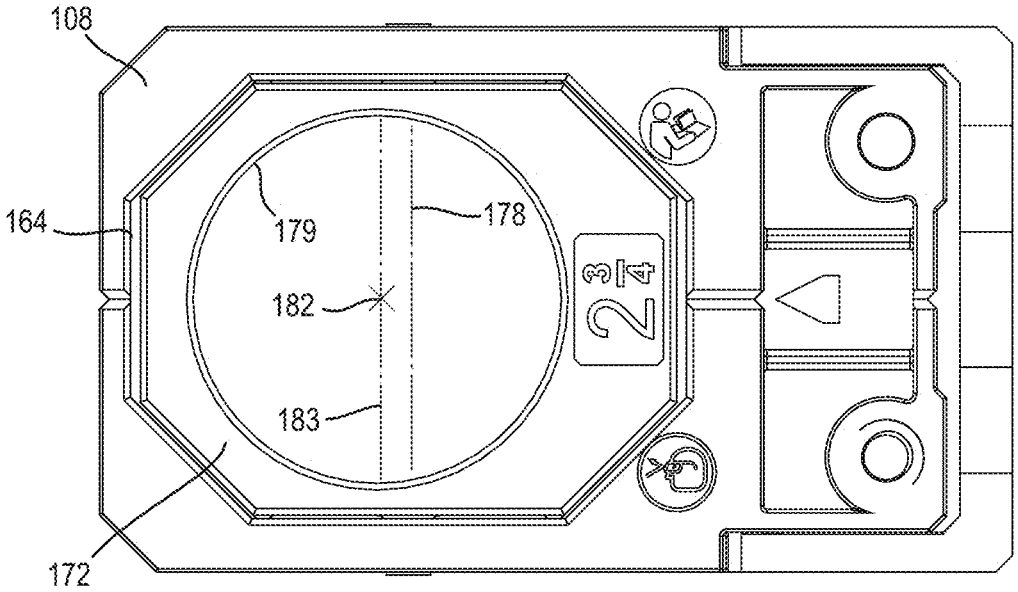
FIG. 8 is a front view of the tool of FIG. 2, with the insert in a second position to provide a second backset distance.
Figure 9:
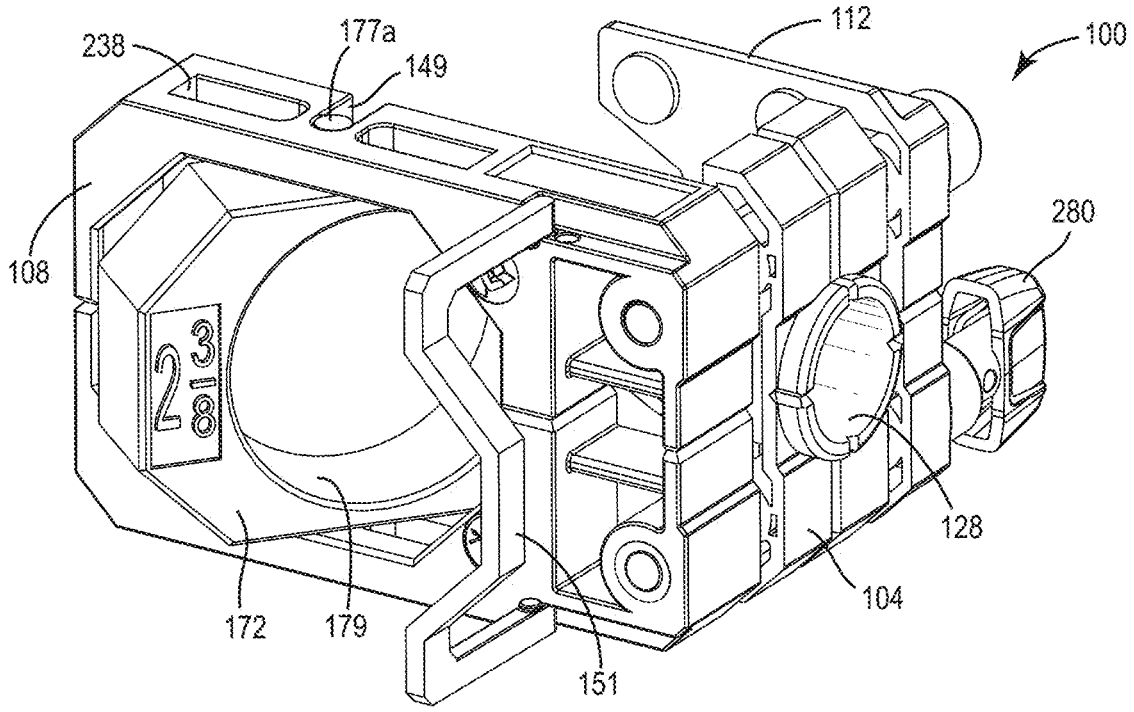
FIG. 9 is another perspective view of the tool of FIG. 2, with the insert between the first and second position.
Figure 10:
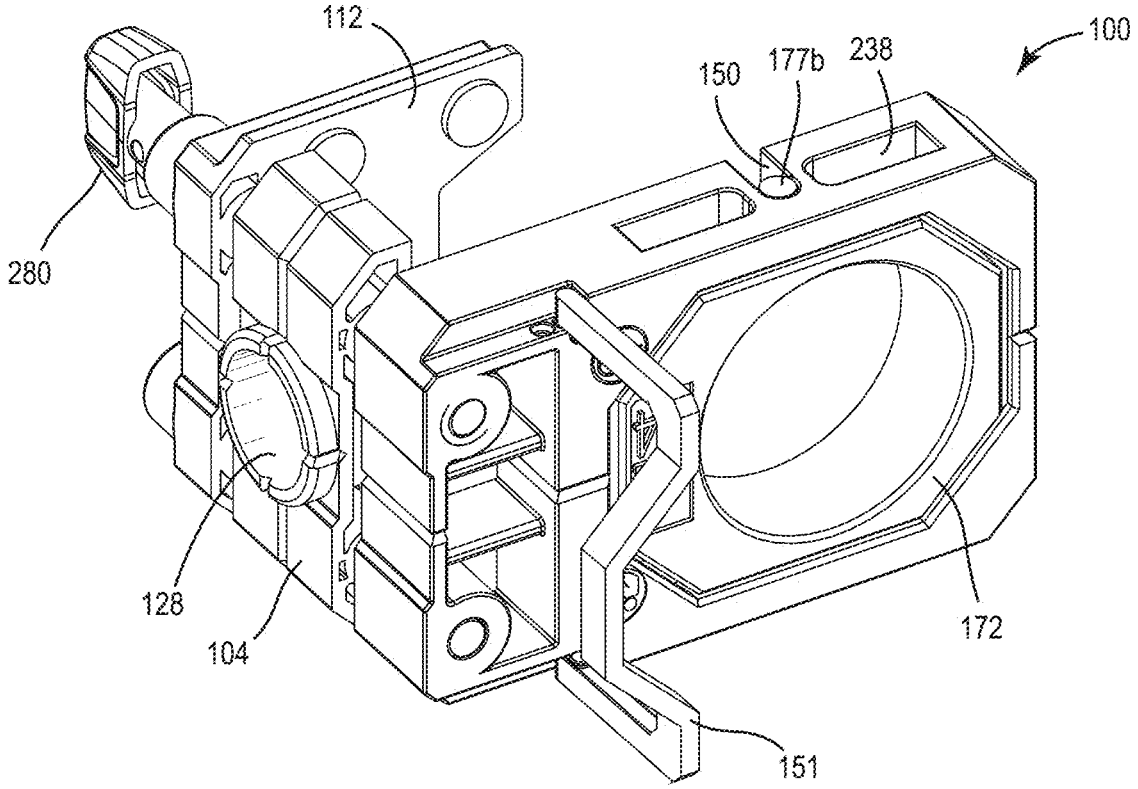
FIG. 10 is another perspective view of the tool of FIG. 2, with the insert in the second position.

With reference to FIG. 3, the first wall 108 includes a first side 136, a second side 140 opposite the first side 136, and top and bottom sides 144, 148 extending between the first and second sides 136, 140. Each of the top and bottom sides 144, 148 has a recess 149, 150, respectively. A handle 151 is pivotably coupled to the second side 140 of the first wall 108 (FIGS. 8-10). The second wall 112 includes a first side 152 generally facing the first wall 108 and a second side 156 opposite the first side 152.

With respect to FIG. 3, an aperture 160 extends through the first side 136 of the first wall 108, and an aperture 164 extends through the second side 140. In the illustrated embodiment the aperture 160 is generally rectangular, but in other or additional embodiments the aperture may be any suitable shape (i.e., circular, ovular, etc.). In the illustrated embodiment, the aperture 164 is generally polygonal, but in other or additional embodiments the aperture 164 may be any suitable shape (i.e., circular, ovular, rectangular, etc.). A portion of the first wall 108 is substantially hollow to define a cavity 168 between the sides 136, 140, 144, 148. The cavity may be defined between the apertures 160, 164.

As shown in FIGS. 2-4, an insert 172 is received within the cavity 168. The insert 172 has a body 175 that has the substantially same shape as the aperture 164. The body 175 has a top side 176*a*, a bottom side 176*b*, a first side 176*c*, and a second side 176*d*. A material of the body 175 is thicker on the first side 176*c* than on the second side 176*d*. The body 175 has a first projection 177*a* that extends from the top side 176*a* of the body 175 and is received in the recess 149 in the first wall 108 and a second projection 177*b* that extends from the bottom side 176*b* of the body 175 and is received in the recess 150 in the first wall 108. In other or additional embodiments, the body 175 and the first wall 108 may be coupled by another configuration. For example, in other or additional embodiments, the body 175 may have recesses that receive projections extending from the body 175 or the body 175 may have a recess that receives a projection of the insert 172 and a projection that is received by a recess in the insert 172.

Further with respect to FIGS. 2-4, the insert 172 defines a rotation axis 178 that extends between the first and the second projections 177*a*, 177*b*. The rotation axis 178 is parallel to the longitudinal axis 12 of the door 10 when the tool 100 is in use. The rotation axis 178 is perpendicular to the edge bore axis 132. A cross bore aperture 179 extends through the body 175. The cross bore aperture 179 provides a pathway through the first wall 108. The cross bore aperture 179 functions as a cross bore locator, and the center of the cross bore aperture 179 lies on a cross bore axes 182, 183. The cross bore axis 182 is substantially normal to and coplanar with the edge bore axis 132. The cross bore axis 183 is offset from and parallel to the rotation axis 178. Accordingly, there is a distance 184 between the cross bore axis 183 and the first side 176*c* of the body 175 that is longer than a distance 185 between the cross bore axis 183 and the second side 176*d* of the body 175. The cross bore aperture 179 is sized to receive a cutting tool, such as a hole saw or a drill bit, that is the proper size for creating the cross bore 22. In other embodiments, the cross bore aperture 179 could be larger than the desired cross bore size, and adapters that match standard cross bore sizes could be provided for insertion into the aperture 179.

Figure 5:
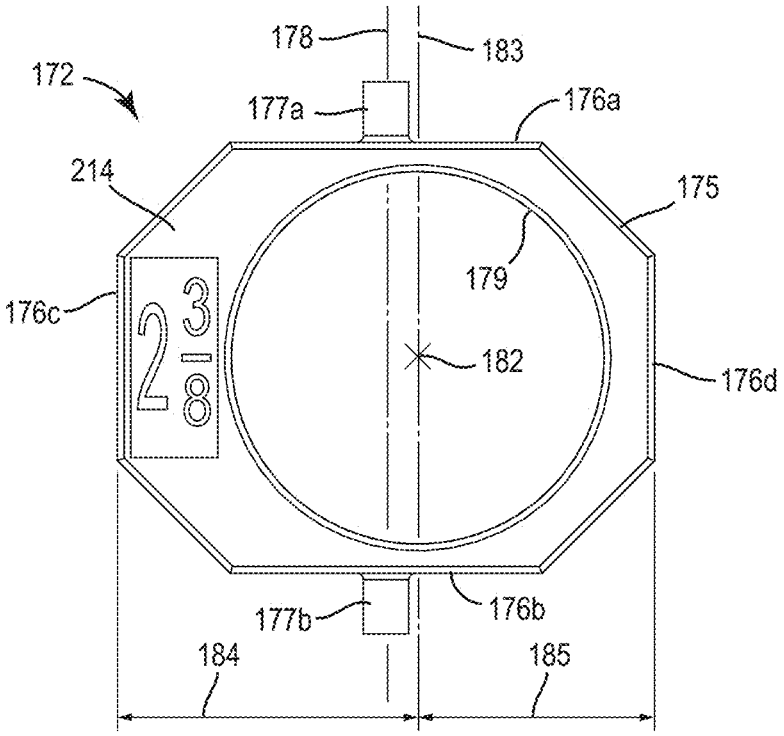
FIG. 5 is a first side view of an insert of the tool of FIG. 2.
Figure 6:
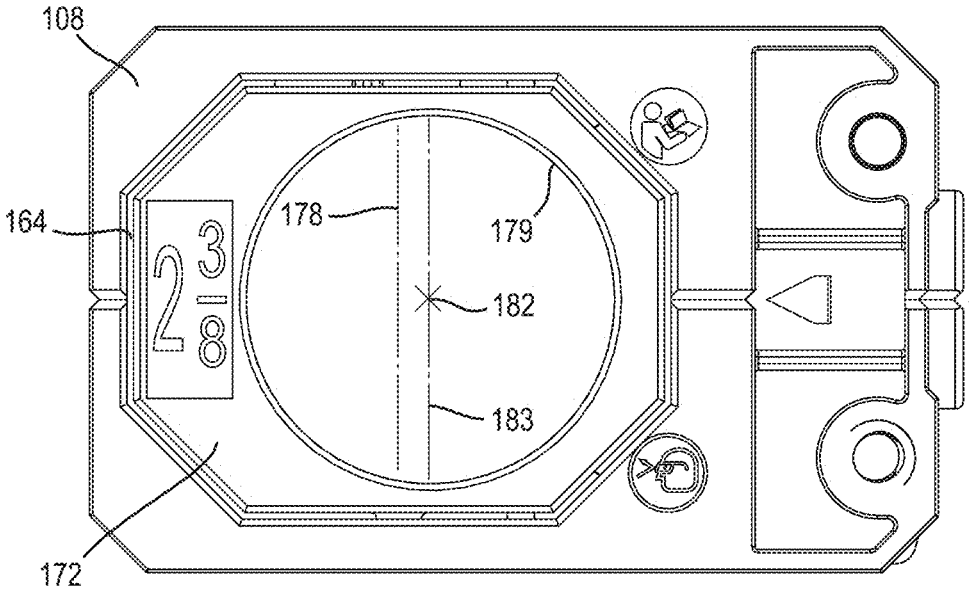
FIG. 6 is a front view of the tool of FIG. 2 with the insert in a first position to provide a first backset distance.

With reference to FIGS. 5-9, the insert 172 is rotatable within the cavity 168 and about the rotation axis 178 between a first position (FIGS. 5-6) and a second position (FIGS. 7-8) to adjust the position of the cross bore aperture 179 and therefore, the backset distance 46. In the illustrated embodiment, the cross bore axis 182 is spaced about 2⅜ inches from the second side 124 of the edge wall 104 when the insert 172 is in the first position (FIG. 5-6). This corresponds with a backset distance 46 of 2⅜ inches (6.03 centimeters) when the tool 100 is properly positioned on the door 10 of FIG. 1. When the insert 172 is in the second position (FIG. 7-8), the cross bore axis 182 is spaced about 2¾ inches from the second side 124 of the edge wall 104, corresponding with a backset distance 46 of 2¾ inches when the tool 100 is properly positioned on the door 10 of FIG. 1.

Figure 12:
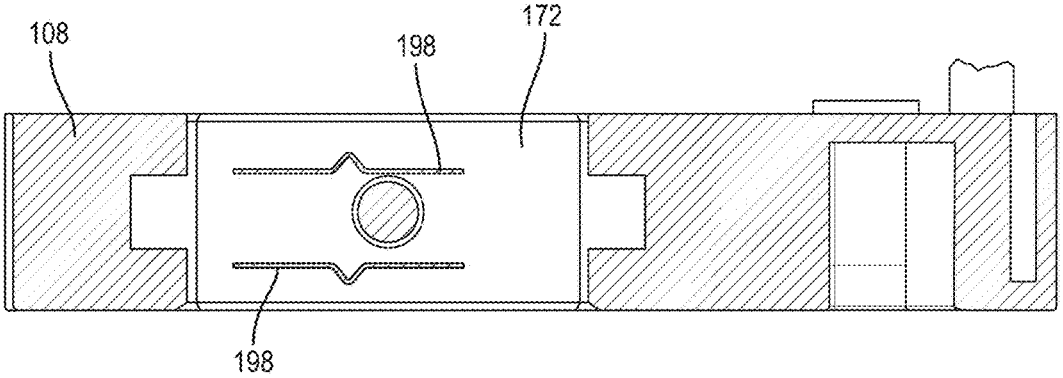
FIG. 12 is a cross-sectional view of the tool of FIG. 2, taken through the line 12-12 of FIG. 2.

With reference to FIG. 12, the tool 100 includes a pair of resilient members 198 positioned between the cavity 168 and the insert 172. In the illustrated embodiment, the resilient members 198 add friction between the cavity 168 and the insert 172 to help control the speed of the rotation of the insert 178. In other or alternative embodiments, the tool 100 can include positive positioning arrangements, such as a detent arrangement.

With reference again to FIGS. 5-8, the insert 172 can include indicia for indicating to a user of the tool 100 whether the insert 172 is in the first position or the second position. In the illustrated embodiment, the insert 172 includes a first indicium 214 a first side of the insert 178 and a second indicium 222 on a second side of the insert 178 when the insert 172 is in the second position.

Although not shown in this embodiment, the insert 172 may include a plurality of slots extending from the cross bore aperture 179 through the bottom of the insert 172. Similarly, the first wall 108 includes a plurality of slots 238 extending through its bottom side 148. The slots of the insert 172 may be generally aligned with the slots 238 of the first wall 108 to permit egress of sawdust and other debris generated during creation of the cross bore 22.

Figure 11:
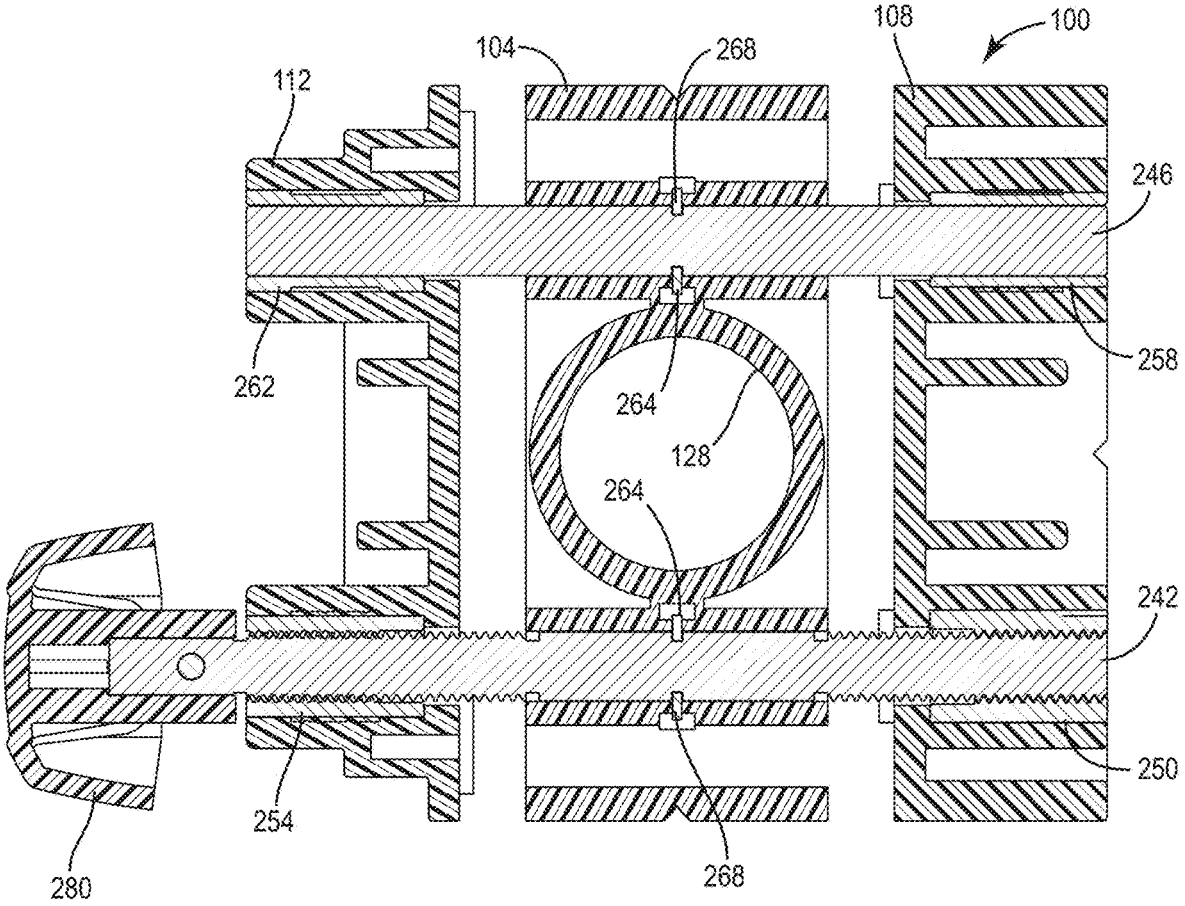
FIG. 11 is a cross-sectional view of the tool of FIG. 2, taken through the line of 11-11 of FIG. 2.

The clamping mechanism 116 will now be described with reference to FIGS. 3 and 4. The clamping mechanism 116 includes first and second, vertically-spaced rods 242, 246 that extend through the first wall 108, edge wall 104, and second wall 112 to couple the walls 108, 104, 112 together. The first rod 242 is a threaded rod and is threadably engaged with a first bushing 250 supported within the first wall 108 and a second bushing 254 supported within the second wall 112. The second rod 246 is as a non-threaded rod and is slidably engaged with a third bushing 258 supported within the first wall 108 and a fourth bushing 262 supported within the second wall 212. Each of the rods 242, 246 is axially fixed within the edge wall 104 such that the rods 242, 246 remain centered relative to the edge wall 104. In the illustrated embodiment, each of the rods 242, 246 includes a groove 264 that receives a snap ring 268 to axially fix the rods 242, 246 within the edge wall 104 while permitting the rods 242, 246 to rotate relative to the edge wall 104 (FIG. 11). In other embodiments, the rods 242, 246 can include a shoulder received in a corresponding recess of the edge wall 104, or any other suitable arrangement for axially fixing the rods 242, 246 within the edge wall 104.

With continued reference to FIGS. 3, 4, and 11, the first bushing 250 includes right-hand threads and the second bushing 254 includes left-hand threads. Alternatively, the first bushing 250 can include left-hand threads and the second bushing 254 can include right-hand threads. The first and second bushings 250, 254 include opposite thread orientations so that rotation of the first rod 242 causes translation of the first and second walls 108, 112 in opposite directions. For example, rotation of the first rod 242 in a first direction (e.g., clockwise) causes the first and second walls 108, 112 to move towards each other, allowing the tool 100 to be securely clamped on to the door 10. Rotation of the first rod 242 in a second direction (e.g., counterclockwise) causes the first and second walls 108, 112 to move away from each other, allowing the tool 100 to be removed from or repositioned on the door 10. The first and second bushings 250, 254 have the same thread pitch. Therefore, the first and second walls 108, 112 move towards/away from each other at the same rate relative to the edge wall 104 to automatically center the edge bore 128 when the tool 100 is positioned on a door 10. A knob 280 is coupled to an end 284 of the first rod 242 to facilitate rotation of the first rod 242.

Referring again to FIG. 2, the tool 100 includes alignment markings 288 to facilitate proper positioning of the tool 100 on the door 10. In the illustrated embodiment, the alignment markings 288 include a vertical groove 292 extending along the center of the edge wall 104 and a horizontal groove 296 extending along the center of the first wall, the edge wall, and the second wall. A portion of the horizontal groove 296 is located in the polygonal-shaped aperture 164 and the cross bore aperture 179. In other embodiments, the alignment markings 288 may include printed markings (e.g., lines) to facilitate proper positioning of the tool 100 on the door 10.

Figure 13:
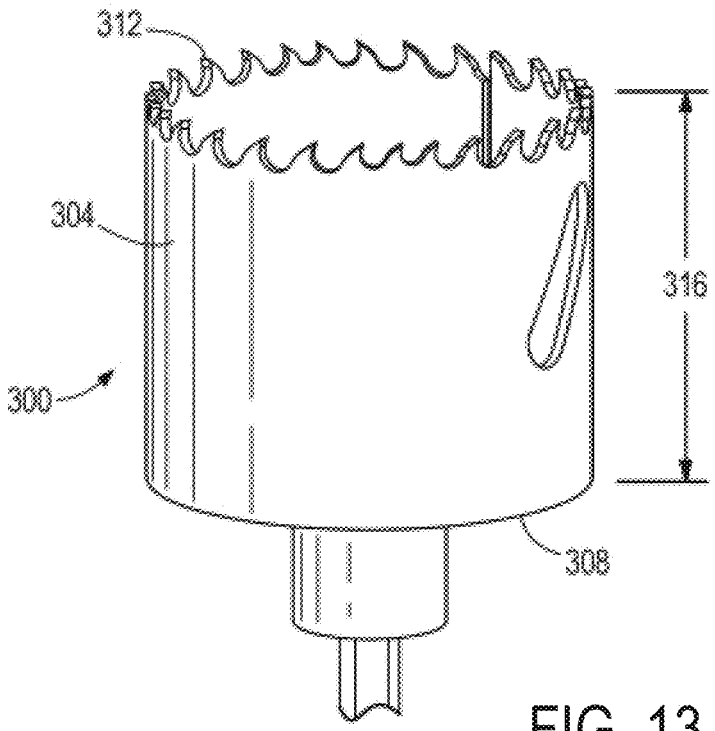
FIG. 13 is a perspective view of a hole saw and a hole saw plug usable with the tool of FIG. 2.
Figure 14:
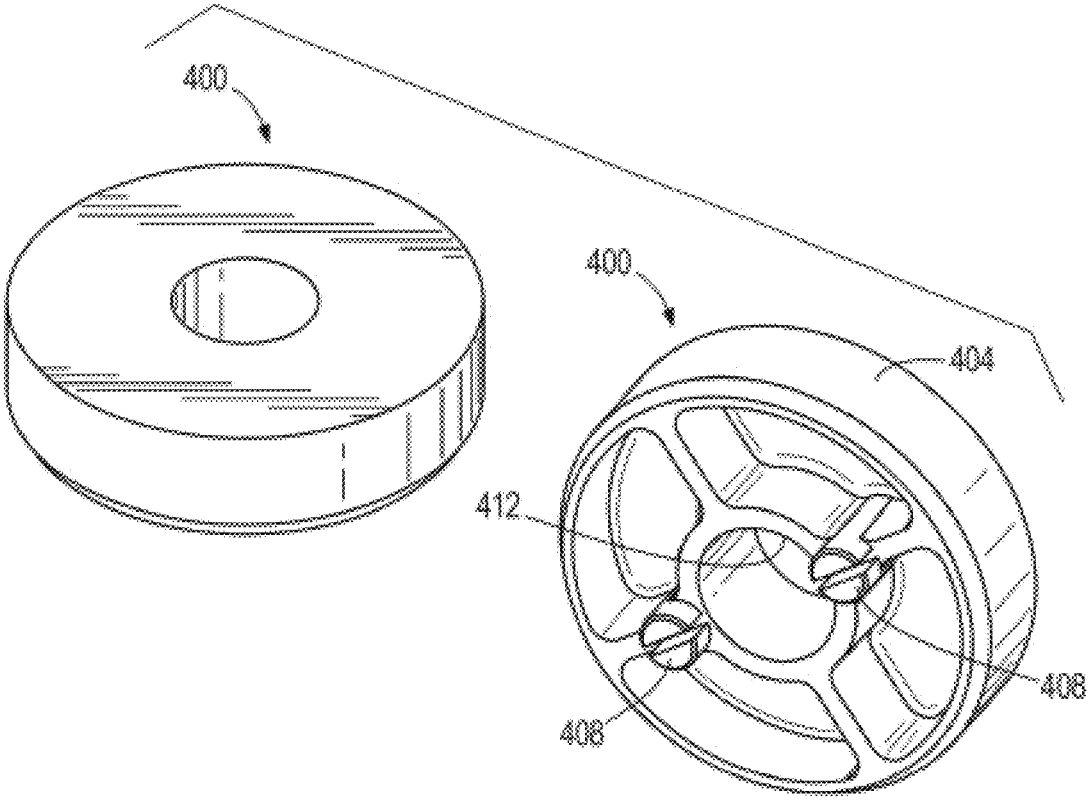
FIG. 14 is another perspective view of the hole saw plug of FIG. 11.

FIG. 13 illustrates a hole saw 300 usable with the door hardware locating tool 100 of FIGS. 2-12 to create the cross bore 22 in the door 10 of FIG. 1. The hole saw 300 includes a hollow, cylindrical body 304 having a bottom wall 308, and teeth 312 extending axially from the body 304. The hole saw 300 is able to cut to a depth 316 limited by an axial distance between the teeth 312 and the bottom wall 308. In some cases, the depth 316 is greater than the edge width 42 of the door 10, and the hole saw 300 could create the cross bore 22 in a single pass (e.g., from the first side 26 of the door 10 to the second side 30). This may cause the backside (e.g., the second side 30) of the door 10 to chip or splinter. A hole saw plug 400 can be inserted into the body 304 of the hole saw 300 to act as a depth stop (i.e., the hole saw plug 400 reduces the maximum cutting depth 316 of the hole saw 300). The plug 400 prevents a user from drilling entirely through the door 10, forcing the user to drill from both sides 26, 30 of the door 10 to complete the cross bore 22. With reference to FIGS. 13 and 14, the plug 400 includes a cylindrical body 404 having a central aperture 412 and projections 408 that engage with corresponding apertures in the bottom wall 308 of the hole saw 300 to retain the plug 400 within the hole saw 300. In some embodiments, the door hardware locating tool 100, the hole saw 300, and the plug 400 may be included together as a kit.

Figure 7:
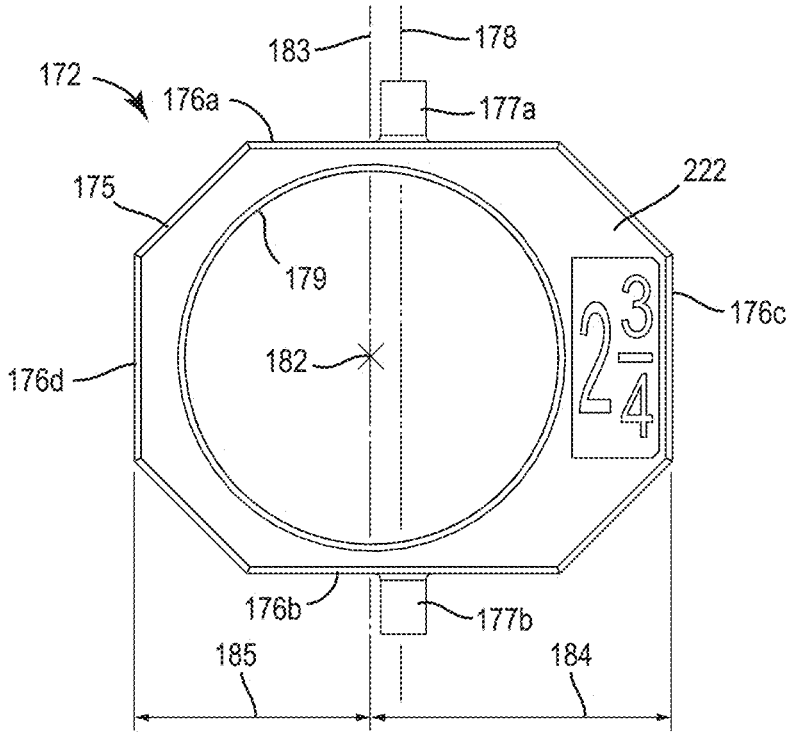
FIG. 7 is a second side view of the insert of the tool of FIG. 2.

In use, a user first measures a desired height of the door hardware to be installed, and marks the desired height on the door 10. Next, the user selects the appropriate backset distance 46 for the cross bore 22 by manipulating the insert 172 to the first position (FIGS. 5-6) or to the second position (FIGS. 7-8). The user then positions the door hardware locating tool 100 so that the second side 124 of the edge wall 104 abuts the latch edge 18 of the door 10, and the horizontal groove 296 is aligned with the desired height mark.

Once the tool 100 is properly positioned, the user tightens the clamping mechanism 116 by rotating the knob 280 and therefore, the first rod 242, in the first direction 272 (FIGS. 3 and 4). The first and second sides 26, 30 of the door 10 are clamped between the first sides 136, 152 of the first and second walls 108, 112 of the tool 100 (FIGS. 1, 3, and 4). Because the first and second walls 108, 112 move towards each other at the same rate, the latch bore aperture 128 is automatically centered on the latch edge 18 of the door 10 as the clamping mechanism 116 is tightened.

To cut the edge bore 14 in the latch edge 18, the user inserts a cutting tool into the edge bore aperture 128 and proceeds to cut a hole into the latch edge 18 (FIGS. 1 and 2). The edges of the cutting tool contact the edge bore aperture 128 to correctly position the edge bore 14 on the latch edge 18.

To cut the cross bore 22 through the door 10, the user inserts the hole saw 300 (or another cutting tool) into the cross bore aperture 179 and proceeds to cut a hole through the door 10 (FIGS. 1, 2, and 10). The edges of the hole saw 300 contact the cross bore aperture 179 to correctly position the cross bore 22 through the door sides 26, 30. Creating the cross bore 22 creates sawdust which is able to fall away from the cross bore 22 through the slots 238. If the user employs the hole saw plug 400 to prevent the hole saw 300 from cutting all the way through the door 10 in a single pass, the user can flip the tool 100 and reposition the tool 100 on the door 10 so that the cross bore aperture 179 is aligned with the partially-formed cross bore 22 on the opposite side of the door 10. The user then inserts the hole saw 300 into the cross bore aperture 179 and proceeds to cut the cross bore 22 through the remaining portion of the door 10. Once the cross bore 22 and the edge bore 14 have been formed, the user loosens the clamping mechanism 116 to remove the tool 100 from the door 10.

Various features of the invention are set forth in the following claims.

What is claimed is:

1. A door hardware locating tool comprising:

an edge wall including a first side, a second side opposite the first side, and an edge bore aperture that extends through the first and second sides, the edge bore aperture defines a first axis that extends through the edge wall and through the first and second sides;

a side wall adjacent the edge wall, the side wall including a first side, a second side opposite the first side, and a cavity defined between the first and second sides; and an insert at least partially positioned within the cavity of the side wall, the insert being rotatable about a second axis that is perpendicular to the first axis between a first position and a second position, the insert including a cross bore aperture.

2. The door hardware locating tool of claim 1, wherein the side wall is a first side wall and the door hardware locating tool further comprises a second side wall adjacent the edge wall and substantially parallel to the first side wall.

3. The door hardware locating tool of claim 2, further comprising a clamping mechanism that couples the first and second walls to the edge wall.

4. The door hardware locating tool of claim 2, wherein the clamping mechanism secures the edge wall adjacent a latch edge of a door.

5. The door hardware locating tool of claim 4, wherein the clamping mechanism includes an actuator that moves the first and second walls towards each other at the same rate to automatically center the edge wall on the latch edge of the door.

6. The door hardware locating tool of claim 1, wherein the first position corresponds to a backset distance of 2⅜ inches and the second position corresponds to a backset distance of 2¾ inches.

7. The door hardware locating tool of claim 1, wherein the insert includes a projection aligned with the second axis, and wherein the side wall includes a recess to receive the projection.

8. The door hardware locating tool of claim 1, wherein the cavity is defined by an opening on the first side of the side wall, and wherein the shape of the insert is substantially the same shape as the opening.

9. The door hardware locating tool of claim 1, wherein the shape of the insert is polygonal.

10. The door hardware locating tool of claim 1, wherein a center of the cross bore aperture defines a cross bore axis that is parallel to and offset from the second axis.

11. The door hardware locating tool of claim 1, wherein the insert includes a first side, a second side opposite the first side, a first indicia positioned on the first side to indicate to a user that the insert is in the first position, and a second indicia positioned on the second side to indicate to a user that the insert is in the second position.

12. The door hardware locating tool of claim 1, wherein the side wall includes slots to permit the egress of sawdust during creation of a cross bore in a door.

13. The door hardware locating tool of claim 1, further comprising alignment markings to facilitate proper alignment of the door hardware locating tool on a door.

14. The door hardware locating tool of claim 1, wherein the edge wall and the side wall are substantially perpendicular.

15. A door hardware locating tool for positioning a cross bore and an edge bore on a door, the door including a longitudinal axis, the door locating tool comprising:

an edge wall including a first side, a second side opposite the first side, and an edge bore aperture that extends through the first and second sides, the edge bore aperture defines a first axis that extends through the edge bore and through the first and second sides;

a side wall adjacent the edge wall, the side wall including a first side, a second side opposite the first side, and a cavity defined between the first and second sides; and an insert at least partially positioned within the cavity of the side wall, the insert being rotatable about a second axis between a first position and a second position, the axis being parallel to the longitudinal axis of the door when the door hardware locating tool is positioned for use, the insert including a cross bore aperture.

16. The door hardware locating tool of claim 15, wherein the first position corresponds to a backset distance of the cross bore of 2⅜ inches and the second position corresponds to a backset distance of the cross bore of 2¾ inches.

17. The door hardware locating tool of claim 15, wherein a center of the cross bore aperture defines a cross bore axis that is parallel to and offset from the second axis.

18. The door hardware locating tool of claim 15, wherein the insert includes a projection extending from the insert along the second axis, the insert being rotatable about the projection.

19. The door locating tool of claim 18, wherein the side wall includes a recess to receive the projection.

20. The door locating tool of claim 15, wherein the insert is rotatable within the cavity.

* * * * *